US007896528B2

(12) United States Patent
Zeng et al.

(10) Patent No.: US 7,896,528 B2
(45) Date of Patent: Mar. 1, 2011

(54) LED LAMP

(75) Inventors: Jun-Hua Zeng, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 350 days.

(21) Appl. No.: 12/134,164

(22) Filed: Jun. 5, 2008

(65) Prior Publication Data

US 2009/0268462 A1 Oct. 29, 2009

(30) Foreign Application Priority Data

Apr. 23, 2008 (CN) ..... 2008 1 0066776

(51) Int. Cl.
*F21V 29/00* (2006.01)

(52) U.S. Cl. ..... 362/294; 362/249.02; 362/373; 362/800

(58) Field of Classification Search ..... 362/294, 362/249.02, 373, 800
See application file for complete search history.

(56) References Cited

U.S. PATENT DOCUMENTS 6,457,847 B1 * 10/2002 LeVasseur ..... 362/351
2009/0213592 A1 * 8/2009 Zhang et al. ..... 362/249.02

* cited by examiner

*Primary Examiner* — Sandra L O Shea
*Assistant Examiner* — Jessica L McMillan
(74) *Attorney, Agent, or Firm* — Frank R. Niranjan

(57) ABSTRACT

An LED lamp includes a housing, a bracket snugly received in the housing, a connecting member fixed to a top of the bracket, a heat sink standing on a top of the connecting member, a plurality of LEDs attached an outer surface of the heat sink and an envelope which is placed on the top of the connecting member, encloses the heat sink and the LEDs therein and engages with the housing. The bracket has a connecting plate. A plurality of electronic components is mounted on a front side of the connecting plate and a plurality fins extending from a rear side of the connecting plate. A covering panel is used to cover an opening of the bracket in front of the connecting plate.

14 Claims, 4 Drawing Sheets

LED LAMP

BACKGROUND OF THE INVENTION

1. Field of the Invention

The present invention relates to an LED lamp, more particularly to an LED lamp having a heat sink enclosed in an envelope for dissipating heat generated by LEDs of the LED lamp.

2. Description of Related Art

The high power LED light devices produce considerable amount of heat, which may cause performance degrade or even damage if the heat is not removed from the LED chips efficiently. In an LED light device, the core is an LED chip mounted on a substrate. A transparent top covering the LED chip serves as a lens for modifying the direction of the emitted light. Although there are many different designs, the major heat dissipation route for the heat produced by the LED chip usually is managed through the base to which the LED chip is mounted or through an additional metal heat sink below the base and then to an outer heat sink.

Traditional adoption of the fans for active cooling system not only introduces noise problems but also brings risk of damage to an LED lamp if the fan is out of order. In contrast, passive cooling with natural convection is quite, continuous and time-unlimited. But since a natural convection system is relative weak for heat dissipation, to solve this problem, a large surface area is needed to enhance heat dissipation capacity. Most passive cooling devices for LED lamps adopt highly heat-conductive materials, such as copper or aluminum, with extended surfaces for heat dissipation. However, to facilitate flowage of airflow through the fins, fins of the heat sink of the LED lamp are commonly exposed to outside of the housing; this makes the fins in a risk of being broken and hurting users of the LED lamp. Furthermore, dust or rainwater on the fins may creep along the heat sink to cause the LEDs to have a contamination by the dust or a short circuit by the rainwater.

What is needed therefore is a LED lamp having an improved structure which overcomes above mentioned disadvantages.

SUMMARY OF THE INVENTION

An LED lamp includes a housing, a bracket snugly received in the housing, a connecting member fixed to a top of the bracket, a heat sink standing on a top of the connecting member, a plurality of LEDs attached an outer surface of the heat sink and an envelope which is placed on the top of the connecting member, encloses the heat sink and the LEDs therein and engages with the housing. Heat generated by the LEDs is absorbed by a spreader of the heat sink and then delivered to fins of the heat sink to be dissipated into air surrounding the heat sink and enclosed by the envelope. The heat sink is totally encapsulated by the envelope; thus, the fins of the heat sink are prevented from being exposed outwardly. Thus, a danger of break of the fins and possibility that the fins may hurt a user of the LED lamp is avoided. In addition, the LEDs can be sufficiently protected by the envelope from attack of dust and rainwater.

BRIEF DESCRIPTION OF THE DRAWINGS

Many aspects of the present LED lamp can be better understood with reference to the following drawings. The components in the drawings are not necessarily drawn to scale, the emphasis instead being placed upon clearly illustrating the principles of the present LED lamp. Moreover, in the drawings, like reference numerals designate corresponding parts throughout the several views.

DETAILED DESCRIPTION OF THE INVENTION

Figure 1:
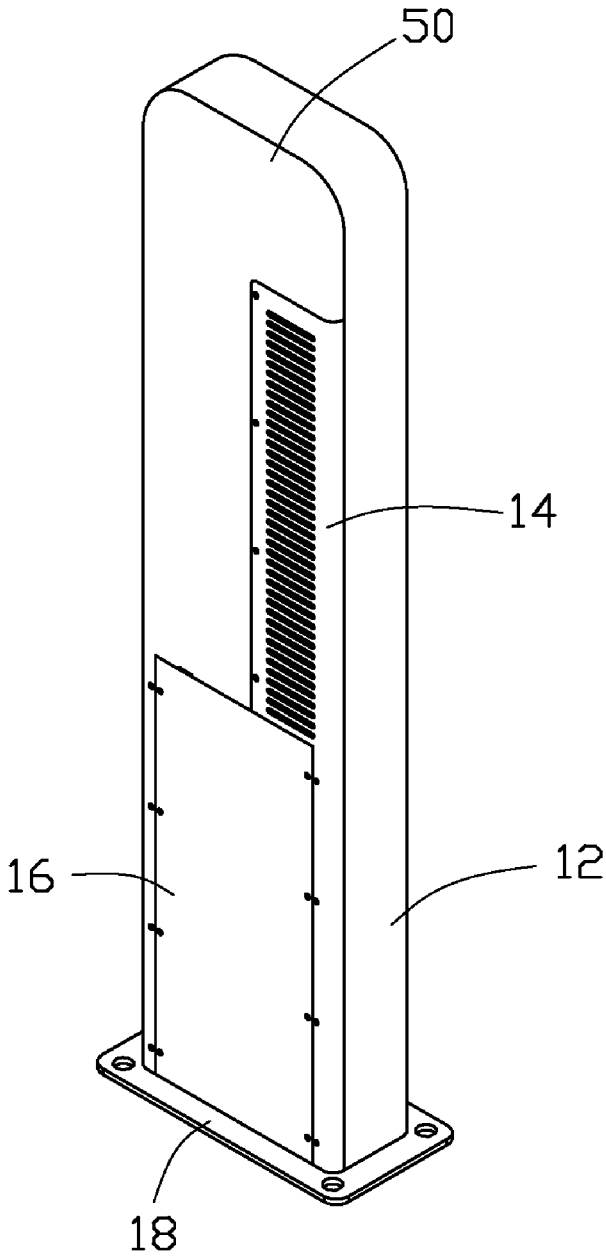
FIG. 1 is an isometric, assembled view of an LED lamp in accordance with a preferred embodiment of the present invention.
Figure 2:
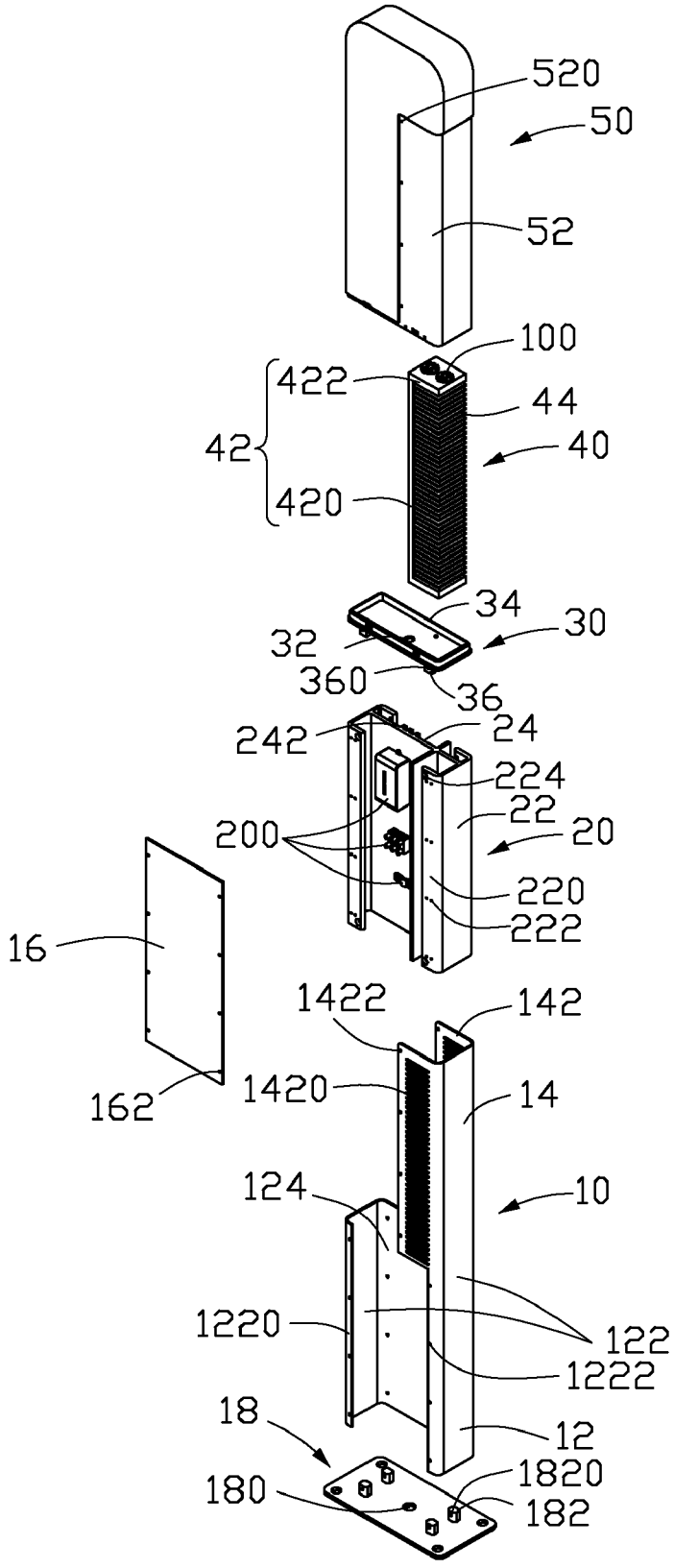
FIG. 2 is an exploded view of FIG. 1.
Figure 3:
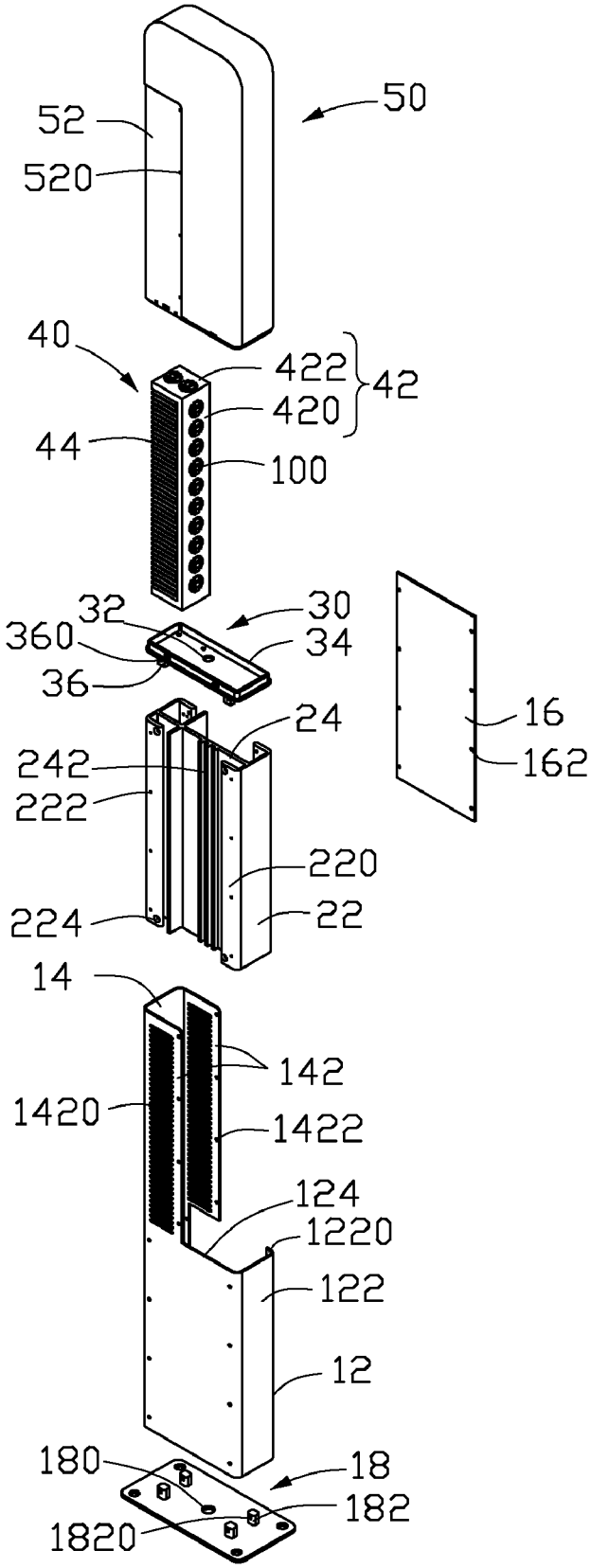
FIG. 3 is an exploded view of the LED lamp of FIG. 1 from another aspect.

Referring to FIGS. 1-3, an LED lamp in according with a preferred embodiment is illustrated. The LED lamp is configured to provide an even illumination in home or in a garden. The LED lamp comprises a housing 10, a bracket 20 snugly inserted into the housing 10, a connecting member 30 coupled to a top of the bracket 20, a heat sink 40 fixed to a top of the connecting member 30, a plurality of light-emitting components (not labeled) mounted on a lateral side and a top of the heat sink 40, and a transparent/translucent envelope 50 mounted over the connecting member 30 and covering the heat sink 40.

The housing 10 comprises a box-shaped main body 12, an extension portion 14 extending upwardly from the main body 12, a covering panel 16 fixed to a front side of the main body 12 by screws (not shown) and a base panel 18 on which the main body 12 is mounted. The main body 12 comprises two parallel side panels 122 and a rectangular rear panel 124 perpendicularly interconnecting rear sides of the two opposite side panels 122. The side panels 122 respectively have two fixing flanged 1220 extending perpendicularly and inwardly toward each other from front sides thereof. Either of the fixing flanges 1220 defines a plurality of through orifices 1222 therein for receiving screws which extend through the covering panel 16. The extension portion 14 is formed by prolonging one of the side panels 122 upwardly and vertically. Two holding flanges 142 extend inwardly and perpendicularly from two opposite sides of the extension portion 14. The holding flanges 142 are provided for clipping the envelope 50 therebetween, and define therein a plurality of strip-shaped vents 1420 parallel to each other and a plurality of piercing orifices 1422 located adjacent to vertical edges of the holding flanges 142. The vents 1420 are provided for decorative purpose.

The covering panel 16 has a size substantially equal to that of the rear panel 124 and is provided to be connected to the two fixing flanges 1220 of the main body 12 to thereby cover an opening (not labeled) between the fixing flanges 1220. The rear panel 124 defines a plurality of through orifices 162 adjacent to two lateral edges thereof. The through orifices 162 are respectively in alignment with the corresponding through orifices 1222 of the fixing flanges 1220 for extension of the screws therein.

The base panel 18 is rectangular and provided for supporting the main body 12 thereon. The base panel 18 in a centre thereof defines a through hole 180 for an upward extension of lead wires (not shown) therethrough. The lead wires are used for electrically connecting the LED lamp to a power source. The base panel 18 has four retaining protrusions 182 extending upwardly from a top surface thereof. The retaining protrusions 182 are respectively located near four corners of the base panel 18 and each define a locking orifice 1820 extending through two opposite sides thereof.

The bracket 20 is integrally made of a highly heat-conductive material such as aluminum or copper, and has a configuration in complementary with an inner spaced of the main body 12 for being snugly inserted into the main body 12 of the housing 10. The bracket 20 has two lateral side plates 22 and a connecting plate 24 interconnecting the two side plates 22. The two side plates 22 are perpendicular to the connecting plate 24 and each has two mounting flanges 220 bent perpendicularly and inwardly from two opposite sides thereof. Each of the mounting flanges 220 defines therein a plurality of engaging orifices 222 arranged along a vertical direction for threadedly receiving the screws extending through the through orifices 162, 1222 of the covering panel 16 and the main body 12 in sequence, thereby securing the covering panel 16 and the flanges 1220 to the bracket 20. Each of the mounting flanges 220 defines therein two fixing holes 224 which are located respectively adjacent to upper and lower ends thereof for fixing the connecting member 30 and the base panel 18 respectively to upper and lower ends of the bracket 20. The connecting plate 24 is closer to the rear ones of the mounting flanges 220 than the front ones, in order to form an accommodating room for receiving related electronic components 200 therein. The related electronic components 200 are mounted on a front side of the connecting plate 24. The connecting plate 24 has a plurality of vertical protruding fins 242 arranged on a rear side thereof, for removing heat generated by the related electronic components 200.

The connecting member 30 is integrally made of a highly heat-conductive material such as aluminum or copper, and configured to support and hold the heat sink 40 and the envelope 50 thereon. The connecting member 30 is rectangular and in a centre thereof defines a through hole 32 for an upward extension of the lead wires therethrough. The connecting member 30 has an engaging flange 34 extending upwardly and perpendicularly from a periphery thereof for engaging with the envelope 50 and holding the heat sink 40 in position. The connecting member 30 has four retaining protrusions 36 extending downwardly from a bottom surface thereof. The retaining protrusions 36 are respectively located near four corners of the connecting member 30. Each retaining protrusion 36 defines a locking orifice 360 extending through two opposite sides thereof for engagingly receiving a screw extending through a corresponding upper fixing hole 224 of the bracket 20 to securely couple the connecting member 30 to the top of the bracket 20.

The heat sink 40 is integrally made of a highly heat-conductive material such as aluminum or copper, and comprises a spreader 42 and a plurality of fins 44 extending outwardly from the spreader 42. The spreader 42 comprises a vertical plate 420 and two horizontal plates 422 extending outwardly and perpendicularly from two opposite top and bottom ends of the vertical plate 420. The fins 44 extend horizontally from a lateral side of the vertical plate 420, are perpendicular to the vertical plate 420 and located between the two horizontal plates 422.

The envelope 50 is made of transparent/translucent plastic or glass and in the form of a cuboid box and configured to be placed on the connecting member 30 and enclose the heat sink 40 therein. The envelope 50 has an opening (not labeled) at a bottom end thereof for snugly receiving the engaging flanges 34 of the connecting member 30 therein and a receiving recession 52 at a corner thereof for accommodating the extension portion 14 of the housing 10. The envelope 50 defines a plurality of retaining orifices 520 in the receiving recession 52 thereof and located adjacent to a brink of the receiving recession 52 for engagingly receiving screws (not shown) which extend through the piercing orifices 1422 of the extension portion 14 of the housing 10 to couple the envelope 50 with the housing 10.

Figure 4:
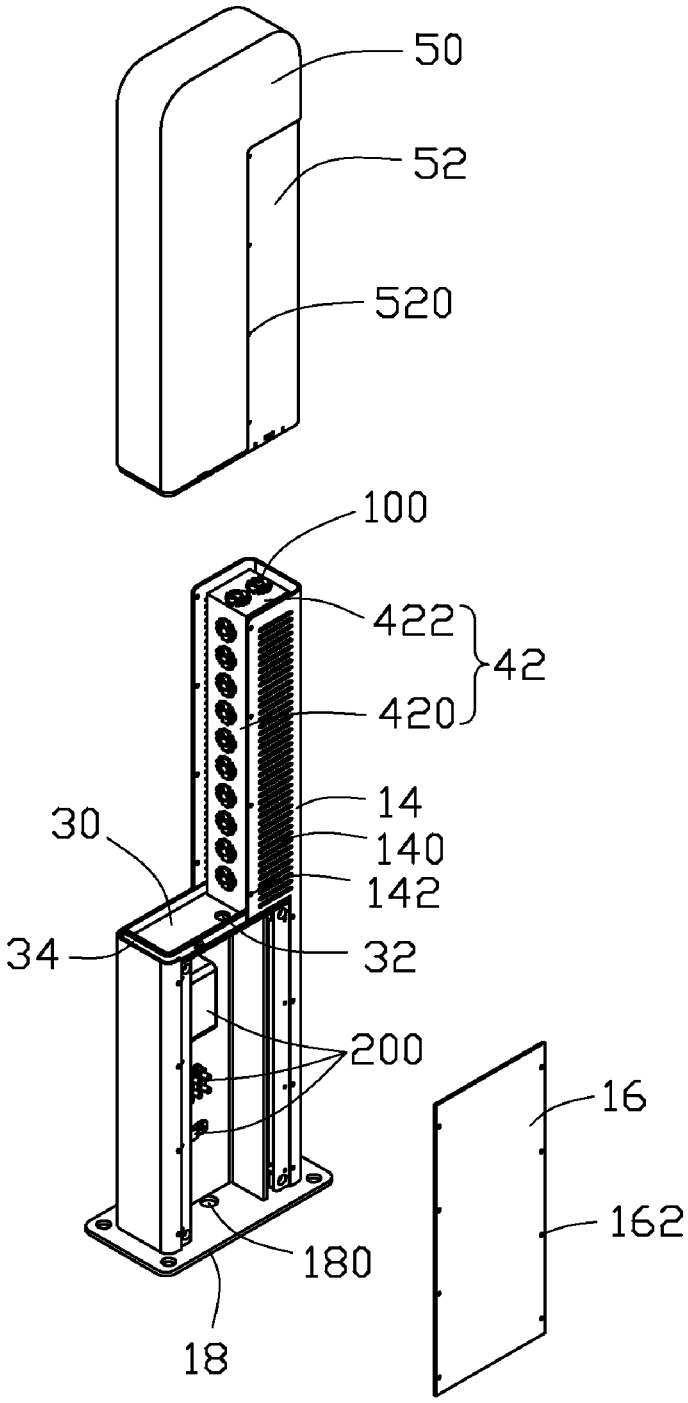
FIG. 4 is a partially assembled view of the LED lamp of FIG. 2 from another aspect.

Also referring to FIG. 4, in assembly of the LED lamp, the bracket 20 is placed on the base panel 18 of the housing 10 and coupled to the base panel 18 by screws extending through the lower fixing holes 224 of the bracket 20 to engage into the locking orifices 1820 of the retaining protrusions 182 of the base panel 18. The connecting member 30 is secured on the top of the bracket 20 by screws extending through the upper fixing holes 224 of the bracket 20 to screw into the locking orifices 360 of the retaining protrusions 36 of the connecting member 30. The bracket 20 assembled with the base panel 18 and the connecting member 30 is then upwardly inserted into the main body 12 of the housing 10. The screws extend through the through orifices 162, 1220 of the covering panel 16 and the main body 12 to screw into the engaging orifices 222 of the bracket 20, to thereby securely connect the bracket 20, the main body 12 of the housing 10 and the covering panel 16 together. The lower horizontal plate 422 of the heat sink 40 is disposed on the connecting member 30 and closely surrounded by the engaging flange 34. The heat sink 40 can be fixed to the top of the connecting member 30 by soldering and adhering. The LEDs 100 are attached to outer surfaces of the vertical plate 420 and the upper horizontal plate 422 of the heat sink 40. The envelope 50 is placed on the connecting member 30, receives the engaging flange 34 of the connecting member 30 in the opening thereof and receives the extension portion 14 of the housing 10 in the receiving recession 52 thereof. The envelope 50 encloses the heat sink 40 to which the LEDs 100 are mounted therein and is coupled with the housing 10 by the screws extending through the piercing orifices 1422 of the extension portion 14 to screw into the retaining orifices 520 of the envelope 50. After assembly, the decorative vents 1420 are located corresponding to the fins 44.

In use of the LED lamp, heat generated by the LEDs 100 is absorbed by the spreader 42 of the heat sink 40 and then delivered to the fins 44 to be dissipated into surrounding air of the heat sink 40. The heat sink 40 is totally encapsulated by the envelope 50, thus avoiding rainwater or dust from reaching the heat sink 40 to cause the LED 100 to have a short circuit by the rainwater or a contamination by the dust. In addition, since the fins 44 are totally enclosed by the envelope 50, the fins 44 are protected from break. Also, it is not possible for the fins 44 to hurt a user of the LED lamp.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a housing;

a bracket snugly received in the housing;

a connecting member fixed to a top of the bracket;

a heat sink standing on a top of the connecting member;

a plurality of LEDs attached an outer surface of the heat sink; and an envelope placed on the top of the connecting member, enclosing the heat sink and the LEDs therein and engaging with the housing.

2. The LED lamp of claim 1, wherein the housing comprises a box-shaped main body, an extension portion extending upwardly from the main body, a covering panel fixed to a front side of the main body and a base panel on which the main body is mounted.

3. The LED lamp of claim 2, wherein the extension portion is formed by prolonging a side panel of the main body upwardly and vertically and has two holding flanges bent inwardly and perpendicularly from two opposite sides extension portion, and the holding flanges clip the envelope therebetween and define therein a plurality of strip-shaped decorative vents parallel to each other, and the heat sink is located between the two holding flanges.

4. The LED lamp of claim 2, wherein the base panel is rectangular, has four retaining protrusions extending upwardly from a top surface thereof, each of the retaining protrusions therein define a locking orifice adapted for threadedly receiving a screw extending through a lower portion of the bracket.

5. The LED lamp of claim 1, wherein the bracket has two lateral side plates and a connecting plate interconnecting the two side plates, each of the two side plates abutting against inner side of the housing has two mounting flanges bent perpendicularly and inwardly from two opposite sides thereof.

6. The LED lamp of claim 1, wherein the connecting member has an engaging flange which extends upwardly and perpendicularly from a periphery thereof and engages with a bottom end of the envelope and four retaining protrusions which extend downwardly from a bottom surface thereof and each define a locking orifice adapted for receiving a screw extending through an upper portion of the bracket to fix the connecting member to the top of the bracket.

7. The LED lamp of claim 1, wherein the heat sink comprises a spreader and a plurality of fins extending outwardly from the spreader, the spreader has a vertical plate from which the fins extend horizontally and two horizontal plates extending outwardly and perpendicularly from two opposite ends of the vertical plate.

8. The LED lamp of claim 7, wherein the fins are parallel to and located between the two horizontal plates.

9. The LED lamp of claim 7, wherein a lower one of the two horizontal plates is placed on the connecting member, the LEDs are fixed to a top surface of an upper one of the two horizontal plates and a vertical outer surface of the spreader.

10. The LED lamp of claim 1, wherein the envelope is made of transparent/translucent plastic or glass and in the form of a cuboid box.

11. The LED lamp of claim 10, wherein the envelope has an opening which is defined in a bottom end of the envelope and engages with the connecting member, and a receiving recession which is located at a corner of the envelope and accommodates an upper portion of the housing.

12. An LED lamp comprising:

a housing;

a bracket snugly received in the housing, the bracket having a connecting wall, a plurality of electronic components being mounted on a front side of the connecting wall and a plurality of fins extending from a rear side of the connecting wall;

a connecting member fixed to a top of the bracket;

a heat sink standing on a top of the connecting member;

a plurality of LEDs attached an outer surface of the heat sink; and an envelope placed on the top of the connecting member, enclosing the heat sink and the LEDs therein and engaging with the housing.

13. The LED lamp of claim 12, wherein the heat sink has a plurality of fins and the housing has decorative vents located corresponding to the fins of the heat sink.

14. The LED lamp of claim 12, wherein the housing has a covering panel covering an opening of the bracket in front of the connecting plate.

* * * * *